US008684525B2

(12) United States Patent
Schneider et al.

(10) Patent No.: US 8,684,525 B2
(45) Date of Patent: Apr. 1, 2014

(54) METHOD FOR MACHINING AN EYEGLASS LENS BLANK AND EYEGLASS LENS BLANK COMPRISING A CONNECTING MATERIAL AND BLOCK PIECE

(75) Inventors: Gunter Schneider, Marburg (DE); Helwig Buchenauer, Dautphetal-Buchenau (DE); Klaus Krämer, Dautphetal-Friedensdorf (DE); Stephan Huttenhuis, Marburg (DE)

(73) Assignee: Schneider GmbH & Co. KG, Fronhausen (DE)

( * ) Notice: Subject to any disclaimer, the term of this patent is extended or adjusted under 35 U.S.C. 154(b) by 243 days.

(21) Appl. No.: 12/736,699

(22) PCT Filed: May 7, 2009

(86) PCT No.: PCT/EP2009/055567

§ 371 (c)(1),
(2), (4) Date: Jan. 10, 2011

(87) PCT Pub. No.: WO2009/135920

PCT Pub. Date: Nov. 12, 2009

(65) Prior Publication Data

US 2011/0096290 A1 Apr. 28, 2011

(30) Foreign Application Priority Data

May 7, 2008 (DE) ..... 10 2008 022 660

(51) Int. Cl.
*G02C 7/02* (2006.01)

(52) U.S. Cl.
USPC ..... 351/159.73

(58) Field of Classification Search
USPC ..... 351/159.72–159.77
See application file for complete search history.

(56) References Cited

U.S. PATENT DOCUMENTS 1,952,373 A * 3/1934 Hill ..... 451/390
2009/0242527 A1* 10/2009 Anger ..... 219/121.69

FOREIGN PATENT DOCUMENTS

DE 696 04 116 T2 3/2000
DE 696 21 625 T2 1/2003

(Continued)

*Primary Examiner* — James Greece
(74) *Attorney, Agent, or Firm* — Hudak, Shunk & Farine Co. LPA

(57) ABSTRACT

A machining method for an eyeglass lens blank in which a bock piece is connected, by way of a connecting material, to a first side of the eyeglass lens blank for holding and supporting the eyeglass lens blank in a processing machine, wherein to this end a cavity is made between the block piece and the first side, at least using a sealing or supporting means, wherein the sealing or supporting means has an inner diameter Dd, Ds and sits against the first side in a sealing manner, the connecting material is filled into the cavity or connecting material is provided in the cavity and then the connecting material is cured, the eyeglass lens blank is placed into a milling and/or turning or grinding machine by way of the block piece cast on by way of the connecting material, wherein the eyeglass lens blank is supported on the first side by the connecting material across a diameter Dv that corresponds to the diameter Dd, Ds and wherein the blank and the connecting material are worked off in one of the following machining processes. An eyeglass lens blank having a diameter Dr, said blank being fastened to a block piece through the cast-on connecting material, wherein the connecting material has an outer diameter Dv. The diameter Dv is at most 2 mm to 6 mm, in particular at most 4 mm and is less than diameter Dr.

17 Claims, 3 Drawing Sheets

(56) References Cited

FOREIGN PATENT DOCUMENTS

| | | | |
|---|---|---|---|
| DE | 103 04 388 | A1 | 8/2004 |
| DE | 603 00 120 | T2 | 10/2005 |
| DE | 10 2005 038 063 | A1 | 2/2007 |
| EP | 2 011 604 | A1 | 1/2009 |
| JP | 11 198014 | A | 7/1999 |
| WO | WO 2007/017385 | A2 | 2/2007 |

* cited by examiner

METHOD FOR MACHINING AN EYEGLASS LENS BLANK AND EYEGLASS LENS BLANK COMPRISING A CONNECTING MATERIAL AND BLOCK PIECE

FIELD OF THE INVENTION

The invention relates to a machining method for an eyeglass or spectacle lens blank, preferably made of plastic, in which a block piece for holding and supporting the spectacle lens blank in a machine tool is connected to a first side of the spectacle lens blank by means of a connecting material, wherein for this purpose a cavity is defined between the block piece and the first side using at least a sealing or support means, wherein the sealing or support means has an inside diameter Dd, Ds and is positioned so as to contact the first side, preferably in a sealing manner, in the area of the inside diameter Dd, Ds, the connecting material is filled into the cavity or the connecting material is already provided in the cavity and is subsequently cured. The connecting material need not necessarily be filled or poured in. The connecting material may also have a somewhat more solid form and predefined portions may be applied to the block piece, and the spectacle lens blank is subsequently placed or pressed thereon. The spectacle lens blank is positioned so as to contact the support means in order to determine its relative position to the block piece, and the connecting material is adapted in shape so as to conform and adhere to the spectacle lens blank or the first side. It is only then that the spectacle lens blank delimits the cavity which has been formed and filled in this way. If predefined portions of the connecting material are used, the cavity is only partially delimited by the spectacle lens blank, the block piece, and the support means. It is not necessary to close off the cavity in a sealing manner. In this case, the support means may comprise only three contact points for the spectacle lens blank. The spectacle lens blank is subsequently placed in a milling machine and/or lathe or a grinding machine by means of the block piece which has been cast on using the connecting material, wherein the spectacle lens blank is supported by the connecting material on the first side across a diameter Dv which is equal to the diameter Dd, Ds. Besides machining spectacle lens blanks made of plastic, spectacle lens blanks made of mineral glass can also be supported or machined in this way.

BACKGROUND OF THE INVENTION

As an alternative to the use of cast-on block pieces, which as a rule are made of metal, WO 2007/017385 A2 and DE 10 2005 038 063 A1 teach the use of block pieces made of plastic which would provide sufficient support to the spectacle lens blank. This, however, involves two major drawbacks. On the one hand, the adhesive materials which are currently available to affix the spectacle lens blank to the plastic block piece lack the required holding power. To achieve sufficient holding power, the spectacle lens blank and the block piece must be pressed against each other, thus possibly deforming the spectacle lens blank in an adverse manner, which adversely affects the geometry of the glass or lens, at least once it has been removed from the block. On the other hand, the plastic block pieces have a very low strength, thus adversely affecting the holding position within a chuck of a machine tool.

DE 103 04 388 A1 discloses a block piece for spectacle lens blanks which comprises a coupling part and a holding part. The holding part can be adapted in shape so as to conform and adhere to the spectacle lens blank. The necessary holding power is achieved by heating and pressing, adding an adhesive material if required. The deformation of the spectacle lens blank caused by said pressing is a disadvantage since it adversely affects the geometry of the spectacle lens or lens, at least once it has been removed from the block.

A method for connecting a block piece to a spectacle lens blank by means of a connecting material is already known from DE 696 04 116 T2. The connecting material consists of a heavy metal alloy in this case, which must by no means be machined or damaged during the subsequent process of machining the spectacle lens blank. Therefore, the spectacle lens blank is only supported by the connecting material in the area of the diameter which will in no case be machined, taking into account a safety margin. The diameter cannot be reduced further until the block piece, including the connecting material, has been removed.

SUMMARY OF THE INVENTION

The object of the invention is to design a machining method for a spectacle lens blank and a spectacle lens blank/block piece assembly in such a manner that optimum machining of the spectacle lens blank during machining is ensured.

According to the invention, the aforesaid object is achieved by reducing the size of the blank and the connecting material, or cutting or grinding them, during one of the subsequent machining processes. This enables the spectacle lens blank to be supported almost entirely or in its entirety by the connecting material since the initial excess dimension of the spectacle lens blank extending beyond the connecting material or the periphery of the latter has been removed. The diameter Dd, Ds of the sealing or support means, and therefore the diameter Dv of the connecting material, can be selected independently of the diameter Dr which is given to the spectacle lens blank during machining or to which diameter the spectacle lens blank must be reduced during machining. The connecting material supports the spectacle lens blank as widely or broadly as possible when the latter is mounted on the block, so that an almost 100% support of the semi-finished lens is ensured once the blank diameter Dr has been reduced to the semi-finished lens diameter D1.

For this purpose, it may also be advantageous if the inside diameter Dd, Ds of the sealing or support means is selected dependent on the diameter Dr of the spectacle lens blank, such that the inside diameter Dd, Ds is not more than between 1 mm and 20 mm, in particular not more than between 2 mm and 6 mm, smaller than the diameter Dr of the spectacle lens blank. Since as a rule a spectacle lens blank comprises a very irregular circumferential surface, only the first side of the spectacle lens blank serves as a sealing surface for positioning the sealing means thereon in order to define the cavity for the connecting material. In addition, the prefabricated first side is a more precise reference surface. Since the contact surface of the sealing means on the first side should be minimal in order to ensure a sealing contact between the sealing means and the spectacle lens blank, the aforesaid dimensions for the inside diameter Dd ensure a wide support of the spectacle lens blank. The same is true for the use of a support means having the diameter Ds. The prefabricated first side should be used as a reference surface for the relative position. This is in particular due to the fact that the initial diameter Dr of the spectacle lens blank is reduced to a diameter D1 in a first machining step in order to eliminate the irregularities on the periphery, as explained below.

Therefore, it may be advantageous if in a first step of the machining process, a periphery of the spectacle lens blank is machined and the diameter Dr is reduced to a diameter D1, wherein it is intended that the diameter D1 be equal to the dimension of the diameter Dv or a dimension which is not more than 1 mm to 6 mm larger. As the spectacle lens blank is reduced to the diameter D1, a rotationally symmetric component is created which provides the precision required for the further machining process. To ensure a 100% support, the diameter D1 should have the same dimension as the diameter Dv of the connecting material. This, however, is only possible if it is possible at all to reduce the diameter of the spectacle lens blank to a suitable size, taking into account the spectacle glass which eventually is to be manufactured. Naturally it is also possible that both the spectacle lens blank and the connecting material be reduced to a diameter smaller than D1 in this machining step, as described below.

Furthermore it may be advantageous if in another step of the machining process, a second side of the spectacle lens blank which is opposite the first side is machined or ground, wherein the diameter Dr, Dv of the spectacle lens blank or the periphery and a diameter of the connecting material must be reduced in size, or cut or ground, either before or after machining the second side. When the spectacle lens blank is machined or ground, the round shape of the spectacle lens blank or the semi-finished lens thus manufactured is as a rule maintained, irrespective of the shape of the spectacle lens to be manufactured, while reducing the diameter Dr to a dimension D1 which still allows the desired spectacle lens to be manufactured, as described above. The round shape of the semi-finished lens is as a rule maintained for two reasons. On the one hand, a continuous polishing action can be ensured during the subsequent polishing process in which the semi-finished lens as a rule also rotates, without subjecting the polishing tool to varying contact conditions due to a rotating asymmetric semi-finished lens, especially in the peripheral area. On the other hand irregularities in the coating will be created in the peripheral area during the subsequent coating process, in particular during spin coating, which are removed by finally adapting the diameter of the round semi-finished lens thus manufactured, i.e. by manufacturing the desired non-round or smaller spectacle lens shape.

In exceptional cases, it may be intended that not only the diameter of the spectacle lens blank is reduced to a minimum during the cutting or machining process, but that the spectacle lens blank is also given an oval or polygonal shape deviating from the round shape. According to the invention, it is possible even in this case to support not only the round central part of the semi-finished lens by means of the connecting material but the entire first side of the spectacle lens blank or the semi-finished lens irrespective of its shape. The connecting material will be reduced in size correspondingly during machining.

It may also be advantageous if a protective layer is provided between the spectacle lens blank and the connecting material. The protective layer is as a rule applied in advance to the spectacle lens blank or is already provided on said blank in order to prevent the prefabricated first side from being damaged. The spectacle is therefore indirectly held by the connecting material via the protective layer.

In this context, it may advantageously be intended that the connecting material be introduced into the cavity via several inlet pieces or via several outlet openings of one or more inlet pieces. The inlet pieces or the outlet openings have different direction components, so that the connecting material is not only introduced at various positions of each inlet piece, but is also introduced in different directions or with different direction components within one position of an inlet piece. Naturally the different positions of the inlet pieces also involve different direction components for the connecting material to be introduced.

In this context, it may advantageously be intended that the filling level of the connecting material within the cavity be monitored by means of a laser distance sensor. Other filling level systems function less well. The laser distance sensor has the necessary focus to detect the filling level in the inlet opening from outside. Depending on the connecting material, reflective additives may be provided which allow the filling level to be detected by means of the laser distance sensor, in particular if clear connecting materials are used.

As an alternative, predefined portions of the connecting material may be applied to the block piece, and the spectacle lens blank is subsequently placed and/or pressed thereon, wherein the connecting material is adapted in shape so as to conform and adhere to the spectacle lens blank. In this way, sealing and pouring-in of the connecting material are no longer necessary. The connecting material is cured once it has been adapted in shape so as to conform and adhere to the blank, so that the necessary holding power is developed.

The object of the invention is also achieved by means of a spectacle lens blank having a diameter Dr and which is affixed to a block piece by means of cast-on connecting material, wherein the connecting material (3) has an outside diameter Dv and said diameter Dv is not more than 2 mm to 6 mm, in particular not more than 4 mm, smaller than the diameter Dr. The diameter Dv of the connecting material is maximized in order to provide maximum support to the blank, wherein an excess dimension of the blank extending beyond the connecting material is necessary in order to position the sealing means or block ring thereon.

A major part of the spectacle lens blank has a diameter Dr of 80 mm or 85 mm. If the diameter Dv ranges at least from 65 mm to 90 mm, the support according to the invention is ensured. The diameter Dv is approximately 2 mm smaller than the diameter Dr, so that the following values result for the diameter Dv as a function of the diameter Dr:

| | | | | | | |
|---|---|---|---|---|---|---|
| Dr [mm] | 65 | 70 | 75 | 80 | 85 | 90 |
| Dv [mm] | 63 | 68 | 73 | 78 | 83 | 88 |
| Dv [mm] | 61 | 66 | 71 | 76 | 81 | 86 |

The value of the diameter Dv depends on the space required for sealing or positioning the sealing means. In the above table, 1 mm in the second line and 2 mm in the last line are taken into account for the space required. The resulting difference between the diameters Dr and Dv is therefore 2 mm or 4 mm respectively.

In addition it may be advantageous if the block piece comprises a contact surface acting in an axial direction relative to the central axis, and the contact surface can be positioned so as to contact a chuck in an axial direction in order for the block piece to be held in a chuck of the machine tool. This ensures that the block piece is fixed precisely, which contributes to optimizing the machining process as a whole. Said contact surface has been cast onto the block piece by means of the connecting material so far.

BRIEF DESCRIPTION OF THE DRAWINGS

Further advantages and details of the invention are explained in the patent claims and in the description, and illustrated in the figures, in which:

DETAILED DESCRIPTION OF THE INVENTION

Figure 1:
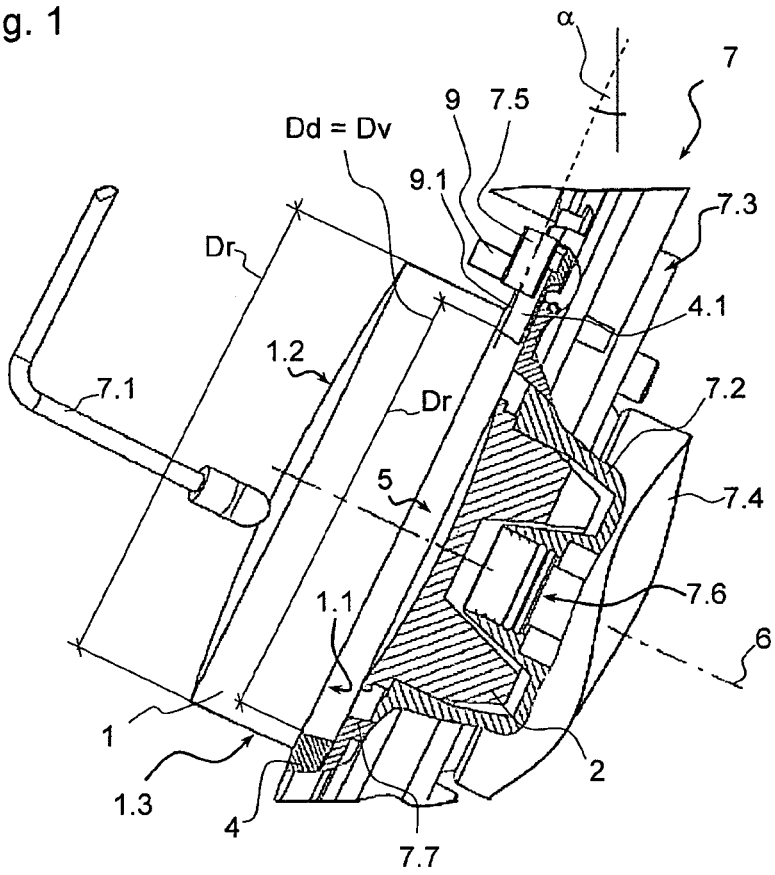
FIG. 1 shows a sectional view of a block piece with a spectacle lens blank placed thereon in a block station.

To mount a spectacle lens blank 1 on a block piece 2, both the block piece 2 and the spectacle lens blank 1 are placed in a mounting machine which is shown in part. The mounting machine 7 comprises a receiving calotte 7.2 into which the block piece 2 is inserted. To align the block piece 2 or the receiving calotte 7.2 relative to the spectacle lens blank 1, a guiding calotte is provided which is supported in the mounting machine 7 via a swivelling plate 7.3. Besides various other drive members, the swivelling plate 7.3 also comprises a rotating shaft 7.4. An ejector is provided for ejecting the block piece later on.

The spectacle lens blank 1 to be mounted is placed above the block piece 2, wherein a block ring which is designed as a sealing means 4 and the guiding calotte 7.7 are placed between the spectacle lens blank 1 and the block piece 2 or the receiving calotte 7.2 in order to provide a cavity 5 which is to be filled with the connecting material 3. The block ring 4 is in sealing contact with the spectacle lens blank 1 or its first lower side 1.1 and with the guiding calotte 7.7. The guiding calotte 7.7 is in sealing contact with the receiving calotte 7.2 while the receiving calotte 7.2 is in sealing contact with the block piece 2.

An inlet opening 4.1 is provided within the block ring 4. In the area of the inlet opening 4.1, a cylindrical or oval inlet piece 7.5 of the mounting machine 7 is arranged via which liquid connecting material 3 is filled into the cavity 5. The inlet piece 7.5 is movable relative to the direction of inflow. Therefore, a distance between the inlet piece 7.5 and the inlet opening 4.1 can be changed to allow for better introduction. In addition, a laser distance sensor 9 is provided behind the inlet piece 7.5, which sensor serves to monitor the filling level in the inlet opening 4.1. A measuring beam 9.1 is introduced from the side and extends approximately in a plane of the central axis of the inlet piece 7.5 during operation. To ensure the position of the spectacle lens blank 1 and the sealing contact, the mounting machine 7 has a holder 7.1 which prestresses the spectacle lens blank 1 in an axial direction against the sealing means or the block ring 4.

The spectacle lens blank 1, the block piece 2, and the block ring 4 with the inlet opening 4.1 are arranged in the mounting machine 7 so as to be inclined at an angle $\alpha$ of approximately 20° relative to the vertical. The connecting material 3 thus exits from the inlet piece 7.5, passes through the inlet opening 4.1, and enters the cavity 5 which is inclined at an angle $\alpha$, thus filling said cavity from bottom to top.

Figure 2:
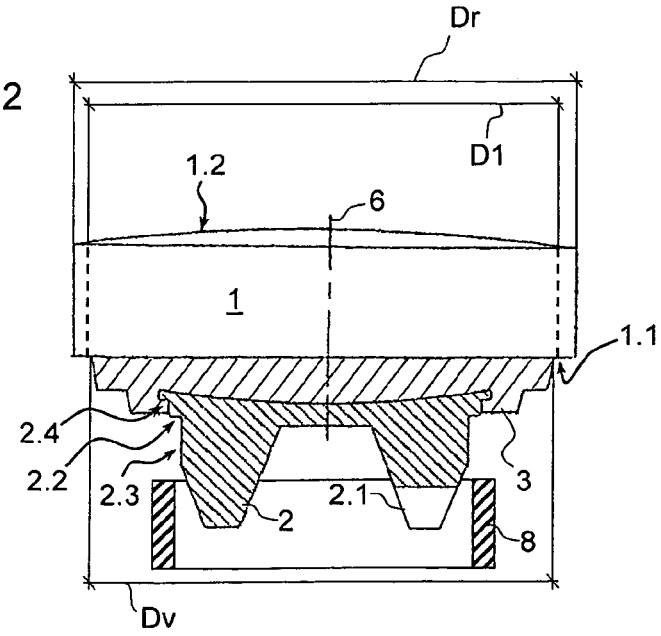
FIG. 2 shows the spectacle lens blank which is mounted on a block piece.

Once the cavity 5 has been filled and the connecting material 3 has cooled down, the assembly according to FIG. 2, which consists of the spectacle lens blank 1, the block piece 2, and the cooled-down connecting material 3 connecting both, is removed from the mounting machine 7 by means of the ejector 7.6.

Based on the inside diameter Dd of the block ring 4, the connecting material 3 has a diameter Dv which is slightly smaller than the diameter Dr of the spectacle lens blank 1. To make the spectacle lens blank 1 rotationally symmetric, it is as a rule reduced to a diameter D1 in a first machining step, wherein the remaining difference between the diameter D1 and the diameter Dv of the connecting material 3 should be as small as possible according to the invention in order to ensure that the spectacle lens blank 1 is supported by the connecting material 3 as much as possible. In another machining step, the periphery 1.3 and/or a second side 1.2 of the spectacle lens blank 1 and the connecting material 3 are machined.

The block piece 2 comprises a first recess 2.1 which can be brought in effective connection with a nose (not shown) of a holding device of a machine in order to ensure an orientation. In addition, a recess (not shown) is provided which serves to transmit a torque. Furthermore, the block piece 2 comprises an axial contact surface 2.2 which is provided adjacent to a cylindrical clamping surface 2.3. Moreover, the block piece 2 has a further projection 2.4 which ensures a form-fit connection acting in a radial direction between the connecting material 3 and the block piece 2.

A chuck 8, shown in FIG. 2, of a machine tool can thus be brought in contact with the cylindrical clamping surface 2.3 in a radial direction and with the axial contact surface 2.2 in an axial direction. The relative position between the block piece 2 and the chuck 8 is therefore not subject to any influences caused by the connecting material 3.

Figure 3A:
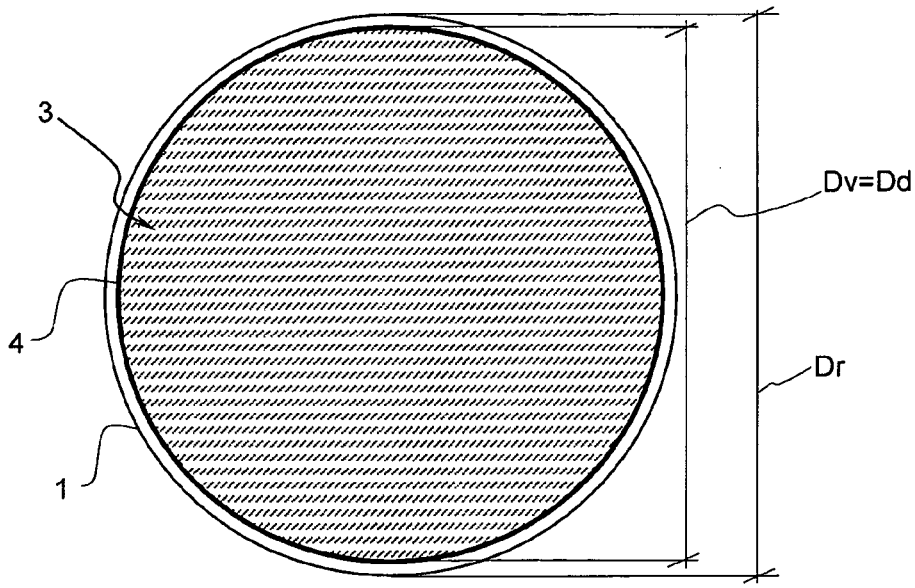
FIG. 3*a* shows a schematic view of a spectacle lens blank with a sealing means and connecting material.

According to FIG. 3*a*, the sealing means 4 has the inside diameter Dd, which is equal to the diameter Dv of the connecting material 3. The inside diameter Dd or the diameter Dv is smaller than the diameter Dr of the spectacle lens blank 1 since the sealing means 4 must be in contact with the first side 1.1 of the spectacle lens blank 1.

Figure 3B:
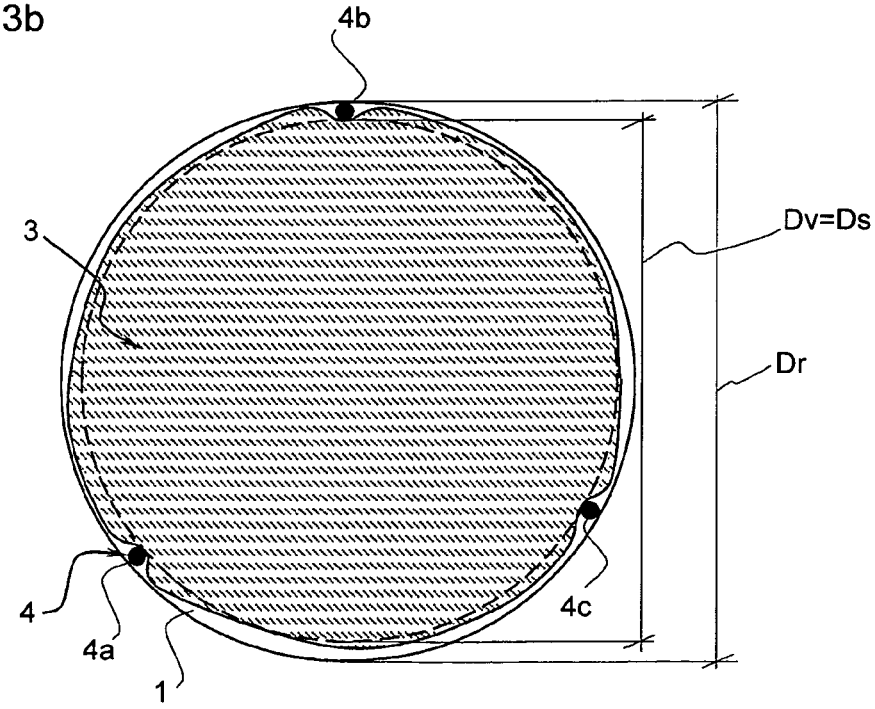
FIG. 3*b* shows a schematic view of a spectacle lens blank with a support means and connecting material.

FIG. 3*b* shows, as an alternative, the use of a support means 4 comprising three support points 4*a*, 4*b*, 4*c* with which the first side 1.1 of the spectacle lens blank 1 must be in contact in order to determine the relative position. The connecting material 3 is adapted in shape so as to conform and adhere to the spectacle lens blank 1 when the latter is placed or pressed thereon and extends radially outwards. The support means 4 has a corresponding diameter Ds which is determined by the three support points 4*a*, 4*b*, 4*c*. The diameter Dv which is effectively available is at least equal to the diameter Ds. In the area between the three support points 4*a*, 4*b*, 4*c*, the effective diameter of the connecting material 3 is even larger, but only along parts of the periphery. Continuous support is provided across the diameter Ds.

Figure 4A:
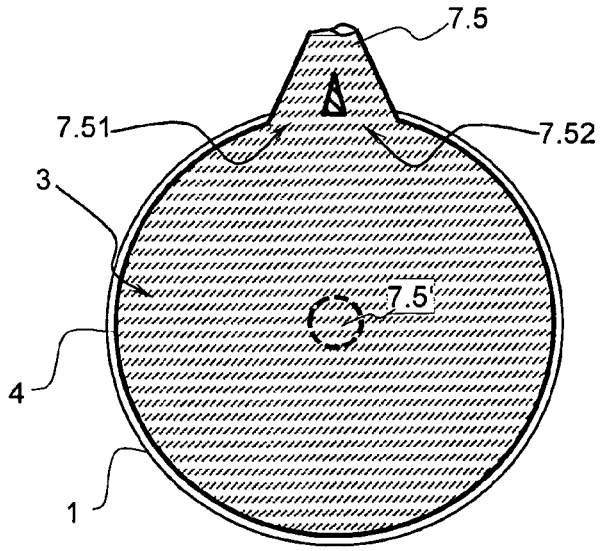
FIG. 4*a* shows a schematic view of the spectacle lens blank with a sealing means and inlet piece.

According to FIG. 4*a*, the inlet piece 7.5 differs from that according to the first exemplary embodiment in that its end is V-shaped and has two outlet openings 7.51, 7.52 which are arranged at an angle of approximately 30° to each other. The outlet openings 7.51, 7.52 may be round or oval. The connecting material 3 entering the inlet piece 7.5 is dispensed with different direction components, i.e. both to the right and left side, so that a more uniform and faster distribution of the connecting material 3 within the cavity 5 is ensured.

As a supplement (or also as an alternative, not shown), an inlet piece 7.5' is provided which is arranged centrally to the spectacle lens blank 1 or to the block ring 4 and via which connecting material 3 can be introduced into the cavity 5 from the centre.

According to the exemplary embodiment of FIG. 4*b*, another inlet piece 7.5" is provided opposite the inlet piece 7.5 and serves to introduce connecting material 3 into the cavity 5 from below, either in addition or as an alternative (not shown). The inlet piece 7.5" is V-shaped as in the exemplary embodiment of FIG. 1. The outlet openings 7.51, 7.52 may be round or oval.

The inlet piece 7.5' which is arranged centrally is also V-shaped in this exemplary embodiment, so that the connecting material 3 is dispensed with different directional components via two outlet openings 7.53, 7.54.

Figure 4B:
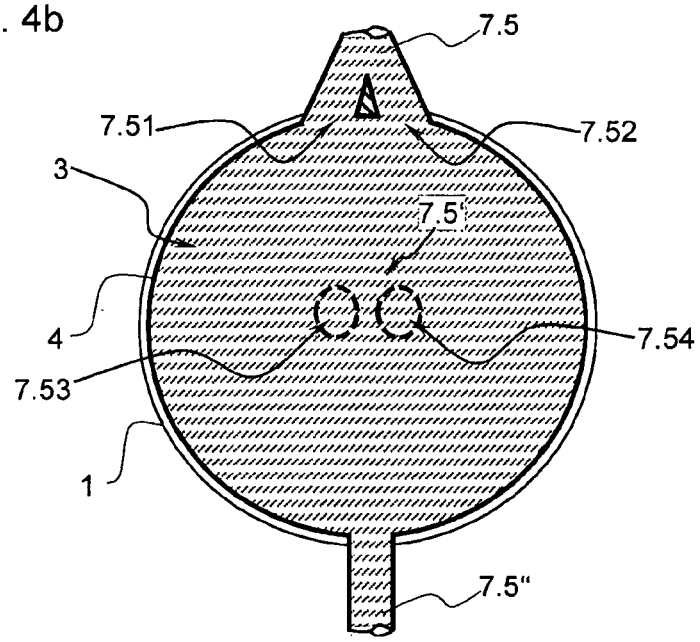
FIG. 4*b* shows a schematic view of the spectacle lens blank with a sealing means and other inlet piece variants.

The inlet pieces 7.5, 7.5', 7.5" which are shown in the exemplary embodiments of FIGS. 4*a*, 4*b* can be used in any combination, as regards both position and design, i.e. cylindrical or V-shaped.

LIST OF REFERENCE NUMERALS

1 Spectacle lens blank
1.1 First side
1.2 Second side
1.3 Periphery
2 Block piece
2.1 Recess for nose
2.2 Contact surface, axial
2.3 Cylindrical clamping surface
2.4 Projection
2.5 Connecting material
4 Sealing or support means, block ring
4*a* Support point
4*b* Support point
4*c* Support point
4.1 Inlet opening
5 Cavity
6 Central axis
7 Mounting machine
7.1 Holder
7.2 Receiving calotte
7.3 Swivelling plate
7.4 Rotating shaft
7.5 Inlet piece
7.5' Inlet piece
7.5" Inlet piece
7.51 Outlet opening
7.52 Outlet opening
7.53 Outlet opening
7.54 Outlet opening
7.6 Ejector
7.7 Guiding calotte
8 Chuck
9 Laser distance sensor
Dd Inside diameter of sealing means=Dv
Ds Inside diameter of support means=Dv
Dv Width or outside diameter of connecting material=Dd
Dr Diameter of blank
D1 Diameter of blank, reduced
α Angle

What is claimed is:

1. A machining method for a spectacle lens blank, in which a block piece for holding and supporting the spectacle lens blank in a machine tool is connected to a first side of the spectacle lens blank by a connecting material, comprising the steps of:

a) defining a cavity between the block piece and the first side using at least a block ring of a mounting machine, wherein the block ring has an inside diameter, Dd or Ds, and is positioned so as to contact the first side, b) filling the connecting material into the cavity or providing connecting material in the cavity and said connecting material is subsequently cured such that the block piece is connected to the first side of the spectacle lens blank by the connecting material, c) removing the spectacle lens blank that has been connected to the block piece by the connecting material from the mounting machine and placing the spectacle lens blank in a milling machine and/or lathe or grinding machine with the block piece which has been connected using the connecting material, wherein the spectacle lens blank is supported by the connecting material on the first side across an outside diameter of the connecting material, Dv, which is equal to the inside diameter, Dd or Ds, of the blocking ring and d) reducing the blank and the connecting material in size in the milling machine, lathe or grinding machine during one of the subsequent machining processes.

2. The method according to claim 1, wherein the inside diameter, Dd or Ds, of the block ring is selected dependent on an initial outer diameter Dr of the spectacle lens blank, such that the inside diameter Dd or Ds is not more than between 1 mm and 20 mm, smaller than the initial outer diameter Dr of the spectacle lens blank.

3. The method according to claim 1, wherein in a first step of the machining process, a periphery of the spectacle lens blank is machined and the initial outer diameter Dr is reduced to a diameter D1, wherein it is intended that the diameter D1 be equal to the dimension of the outside diameter Dv or a dimension which is not more than 1 mm to 6 mm larger.

4. The method according to claim 3, wherein in another step of the machining process, a second side of the spectacle lens blank which is opposite the first side is machined or ground, wherein the periphery of the spectacle lens blank and the connecting material are reduced in size either before or after machining the second side.

5. The method according to claim 1, wherein a protective layer is provided between the spectacle lens blank and the connecting material.

6. The method according to claim 1, wherein the connecting material is introduced into the cavity via several inlet pieces or via several outlet openings of one or more inlet pieces.

7. The method according to claim 1, wherein the filling level of the connecting material within the cavity is monitored by a laser distance sensor.

8. The method according to claim 1, wherein predefined portions of the connecting material are applied to the block piece, and the spectacle lens blank is subsequently placed and/or pressed thereon, wherein the connecting material is adapted in shape so as to conform and adhere to the spectacle lens blank.

9. A spectacle lens blank mounted on a block piece by a connecting material, comprising: the spectacle lens blank having an initial outer diameter Dr and which is connected to a block piece by a cast-on connecting material, wherein the connecting material has a maximum outside diameter Dv, wherein the maximum outside diameter Dv is larger than a maximum diameter of the block piece, wherein the maximum outside diameter Dv of the connecting material is not more than 2 mm to 6 mm smaller than the initial outer diameter Dr of the spectacle lens blank.

10. The spectacle lens blank according to claim 9, wherein the maximum outside diameter Dv has at least a value ranging between 60 mm and 90 mm or is at least 61 mm, 63 mm, 66 mm, 68 mm, 71 mm, 73 mm, 76 mm, 78 mm, 81 mm, 83 mm, 86 mm, or 88 mm.

11. The spectacle lens blank according to claim 9, wherein the block piece comprises a contact surface acting in a radial direction relative to a central axis, and can be positioned so that the contact surface is in contact with a chuck in an axial direction in order to be held in the chuck of a machine tool.

12. The method according to claim 2, wherein the inside diameter Dd or Ds is not more than between 2 mm and 6 mm smaller than the initial outer diameter Dr of the spectacle lens blank.

13. The method according to claim 2, wherein in a first step of the machining process, a periphery of the spectacle lens blank is machined and the initial outer diameter Dr is reduced to a diameter D1, wherein it is intended that the diameter D1 be equal to the dimension of the outside diameter Dv or a dimension which is not more than 1 mm to 6 mm larger.

14. The method according to claim 13, wherein in another step of the machining process, a second side of the spectacle lens blank which is opposite the first side is machined or ground, wherein the periphery of the spectacle lens blank and the connecting material are reduced in size either before or after machining the second side, and wherein a protective layer is provided between the spectacle lens blank and the connecting material.

15. The method according to claim 14, wherein the connecting material is introduced into the cavity via several inlet pieces or via several outlet openings of one or more inlet pieces, wherein the filling level of the connecting material within the cavity is monitored by a laser distance sensor, and wherein predefined portions of the connecting material are applied to the block piece, and the spectacle lens blank is subsequently placed and/or pressed thereon, wherein the connecting material is adapted in shape so as to conform and adhere to the spectacle lens blank.

16. A spectacle lens blank according to claim 9, wherein the maximum outside diameter Dv is not more than 4 mm smaller than the initial outer diameter Dr.

17. A spectacle lens blank according to claim 10, wherein the block piece comprises a contact surface acting in a radial direction relative to a central axis, and can be positioned so that the contact surface is in contact with a chuck in an axial direction in order to be held in the chuck of a machine tool.

* * * * *

UNITED STATES PATENT AND TRADEMARK OFFICE

CERTIFICATE OF CORRECTION

PATENT NO. : 8,684,525 B2
APPLICATION NO. : 12/736699
DATED : April 1, 2014
INVENTOR(S) : Gunter Schneider et al.

It is certified that error appears in the above-identified patent and that said Letters Patent is hereby corrected as shown below:

In the Claims

Wherein in column 8, claim 1, line 6, “blocking” should be replaced with --block--

Signed and Sealed this
Twenty-fourth Day of June, 2014

Michelle K. Lee

Michelle K. Lee
*Deputy Director of the United States Patent and Trademark Office*